US006009291A

United States Patent [19]

Curry et al.

[11] Patent Number: 6,009,291

[45] Date of Patent: Dec. 28, 1999

[54] CONTROL OF PHOTOSENSITIVE ROLLER MOVEMENT

[75] Inventors: Steven Alan Curry, Nicholasville; Paul Douglas Horrall, Lexington; David Lee Merrifield, Lexington; Daniel George Mlejnek, Lexington; James John Molloy, Lexington; Harald Portig, Versailles; Gregory Lawrence Ream; Richard Andrew Seman, Jr., both of Lexington, all of Ky.

[73] Assignee: Lexmark International, Inc., Lexington, Ky.

[21] Appl. No.: 09/025,723

[22] Filed: Feb. 18, 1998

Related U.S. Application Data

[60] Provisional application No. 60/051,041, Jun. 27, 1997.

[51] Int. Cl.[6] ..... G03G 15/00

[52] U.S. Cl. ..... 399/167

[58] Field of Search ..... 399/116, 117, 399/159, 167

[56] References Cited

U.S. PATENT DOCUMENTS

| | | | |
|---|---|---|---|
| 3,727,732 | 4/1973 | Barr | 192/26 |
| 4,256,208 | 3/1981 | Najer et al. | 188/196 D |
| 4,257,510 | 3/1981 | Fisher | 192/207 |
| 5,303,004 | 4/1994 | Maruyama et al. | 399/75 |

OTHER PUBLICATIONS

JPO 410089377A Kitahara, Makato 'Driving Transmission Device and Image Forming Device' Sep. 19, 1996.

JPO 40432105A Sato, Hisao et al 'Imaging Forming Device' Apr. 22, 1991.

The Spring Clutch, Journal of Applied Mechanics, Sep. 1939, pp. A–103 to A–108.

*Primary Examiner*—Arthur T. Grimley
*Assistant Examiner*—George E. Wendal, Jr.
*Attorney, Agent, or Firm*—John A. Brady

[57] ABSTRACT

A toner cartridge (1) contains a photoconductive drum (49) having a central shaft (47). Gear (145) turns with the drum and has a stud (602). A coil spring (604) is mounted on the stud to form a spring clutch which is unwound by the rotation of the drum during imaging. Alternatively, a flat frictional surface is pressed against the side wall **(600*b*)** of the gear. Both contact areas have a light grease. The drag forces provide accurate, smooth operation during imaging.

7 Claims, 14 Drawing Sheets

CONTROL OF PHOTOSENSITIVE ROLLER MOVEMENT

CROSS-REFERENCE TO RELATED APPLICATIONS

This is a continuation of Provisional Patent Application Ser. No. 60/051,041 filed Jun. 27, 1997, having the same title as this application.

The preferred embodiment of this invention is incorporated in a toner cartridge described in several United States patent applications filed Dec. 20, 1996, the one more specifically being directed to the photoconductor roller being Ser. No. 08/770,326 entitled "Toner Cartridge with Locating on Photoconductor Shaft," now U.S. Pat. No. 5,758,233.

TECHNICAL FIELD

This invention relates to electrophotographic development and, more particularly, related to improved control of photosensitive roller movement during imaging operation.

BACKGROUND OF THE INVENTION

Prior to 1997 the assignee of this invention has manufactured and sold commercially toner cartridges of two different general designs. For its larger laser printers the cartridge has contained a pump to meter toner of the kind disclosed in U.S. Pat. Nos. 5,012,289 to Aldrich et al. and 5,101,237 to Molloy, while the external structure of the cartridge is as disclosed in U.S. Pat. No. 5,136,333 to Craft et al. Details of other elements in the cartridge have varied.

For a smaller, light emitting diode printer, the cartridge is as disclosed in U.S. Pat. No. 5,337,032 to Baker et al., which has a toner hopper extending well below a level having the toner adder roller and which has independent driven systems for the photoconductor roller and for the developer roller system as disclosed in U.S. Pat. No. 5,331,378 to Baker et al.

Cartridges are typically located by elements on their cover or frame, not directly based on the location of photoconductor. In 1997 the assignee of this invention began selling a printer with cartridge having the shaft of the photoconductor drum as the primary locator and a flat ledge opposite for resting on a roller member in the printer. This cartridge contains a photosensitive roller, the central shaft of which extends unobstructed to be contacted by the printer as a vertical and front to rear locator. A hopper and developer roller assembly is attached to the cartridge cover assembly through a spring force. The cartridge cover assembly has elongated surfaces to receive a downward pressing member from the printer. The hopper and developer roller assembly has flat ledges to ride on rollers in the printer thereby permitting adjustment of the contact between the photosensitive roller and the developer roller. A cover assembly integral with the photoconductive roller has a locating surface near the hopper which rests on the frame of the printer positively locating the photoconductive roller.

The two front support wheels which define the plane of lateral movement between the two assemblies are in the printer, with a flat surface on the hopper to receive these rollers. Since the under side of the developer unit is part of the media path, referencing the hopper assembly to the printer improves location accuracy of the media path. The cartridge is resistant to rough handling. A minor advantage is that the cost of the wheels and their installation is eliminated from the cartridge.

The photosensitive roller is integral with a gear with teeth. These teeth mesh with a gear from the printer. Other mechanisms in the cartridge are separately driven. However, a photosensitive roller is subject to forces from a paper or other media which are pulled across the roller to transfer the toner image. Another influence is the developer roller, which has a nip contact to the photosensitive roller and a higher tangential velocity.

The photosensitive roller experiences drag from the cleaner blade. However, during use the wear of the cleaner blade results in the drag dropping greatly. Other drag forces, such as at the bearings, are very small.

Paper contacting the photosensitive roller is being pulled by the fixing station while the trailing part of the paper is still in contact with the photosensitive drum. Wrinkle-free paper handling often results in tension from the fuser roller that may be significant.

The effects of low inherent drag on the photosensitive roller, an incidental driving force from the developer roller, and the pull from the fuser roller nip, alone or in combination, can result in imprecise and wavering rotation of the photosensitive roller (termed "jitter"). The teeth between the input gear of the photosensitive roller and the drive gear may actually separate tangentially, resulting in quite apparent distortion of the printed image. Additionally, since pressure at the teeth tends to physically flatten surface defects, loss of such pressure results in some loss of precise rotation and consequent impairment of the printed image.

This invention applies a highly uniform frictional drag to the photosensitive drum. A spring clutch operating in the unwind direction applies such a drag and is so employed. Uniform response is also achieved by having grease at the friction surface. Where drag is produced by lateral movement of two contacting surfaces, the friction characteristics of the grease provide uniform drag. In all cases the grease promotes consistent, smooth operation.

DISCLOSURE OF THE INVENTION

To obtain high precision control of the photosensitive roller from the drive gear intended to control the roller, a frictional member having uniform drag is pressed against the photosensitive roller with the area of contact having a grease. Preferably, the frictional member is a coil spring clutch tightly wrapped around a stud which surrounds the roller shaft, with roller operation being in the direction to unwind the spring. On the side of the spring facing the side wall of the roller, two low friction washers separate the spring from the side wall so that the one contacting the side wall normally turns and the one contacting the spring remains stationary, thereby protecting the end of the spring from rubbing contact.

The term "spring clutch" is used to designate a mechanism in which one end of the spring is prevented from rotating, thereby, as is conventional, permitting the spring to wind tight or unwind depending on the rotation of the shaft on which the spring is wound.

An alternative frictional member is a flat surface pushed into contact with the side wall of the photosensitive roller.

The term "photosensitive roller assembly" is used to incorporate necessary elements to this invention connected to the roller, such as the stud and side wall.

BRIEF DESCRIPTION OF THE DRAWINGS

The details of this invention will be described in connection with the accompanying drawing, in which.

BEST MODE FOR CARRYING OUT THE INVENTION

Figure 1:
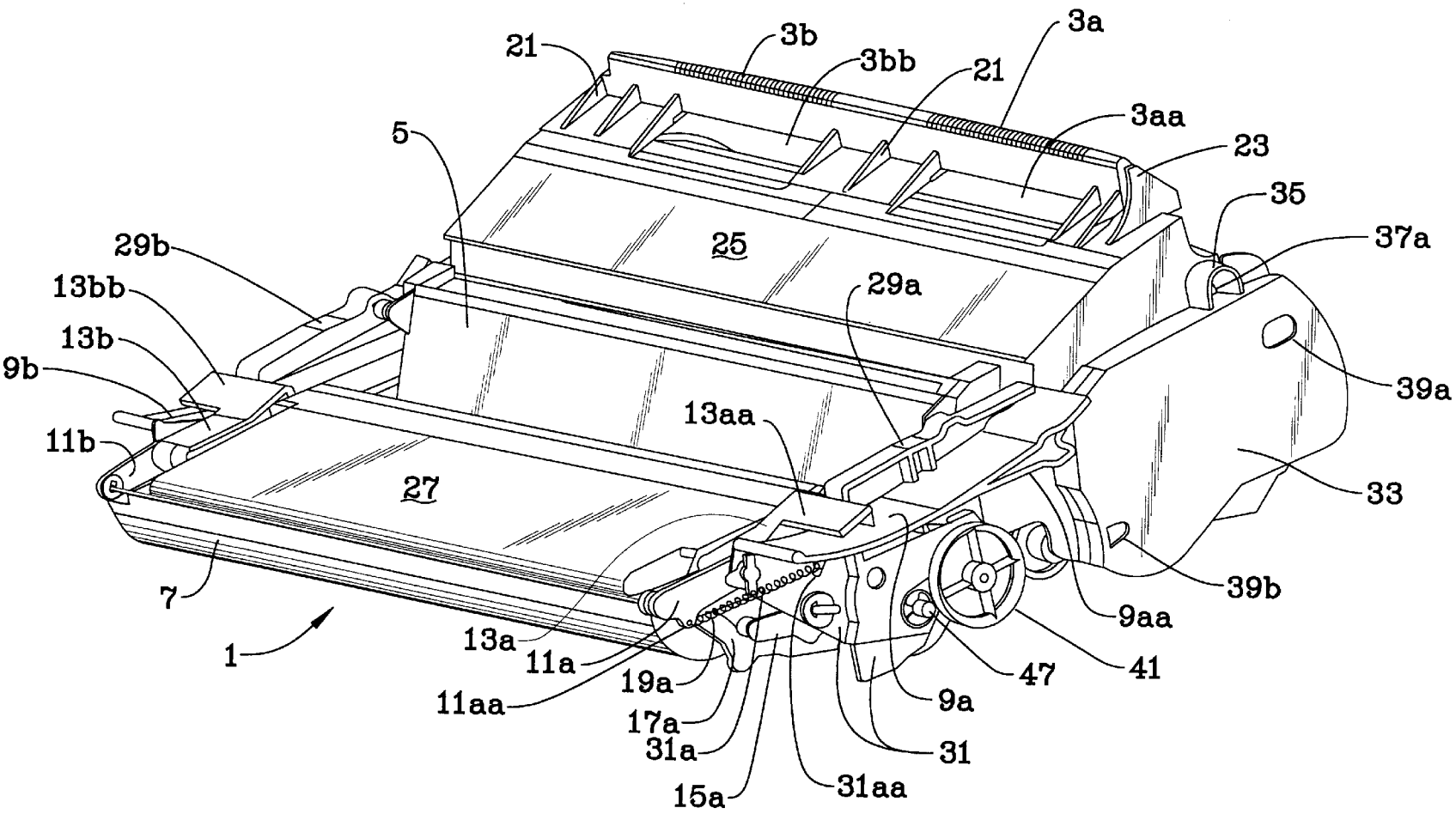
FIG. 1 is a perspective view of the toner cartridge from above and left rear, where left is determined facing the printer from its front side where cartridge insertion is made.

The self-contained, removable printer cartridge 1 is shown in FIG. 1 in a perspective view from above and left rear (the hand grips 3*a* and 3*b* being considered the front and the side having the pivoted upper shutter 5 being the upper side).

For purposes of illustration, FIG. 1 shows the upper shutter 5 pivoted downward to its open position and lower shutter 7 pivoted rearward and upward to its open position. In actual operation, these positions are reached by interaction with the printer or other device in which cartridge 1 is installed as will be explained below.

To facilitate and guide insertion of cartridge 1 into the printer, cartridge 1 has a left guide wing 9*a* and a right guide wing 9*b*. Guide wings 9*a* and 9*b* are thin planes formed as arcs of a relatively large circle, except near the front, where the bottom 9*aa* is enlarged downward. Guide wings 9*a* and 9*b* are mirror images of each other except that, in this particular embodiment described, the left guide wing 9*a* is wider (extends further laterally) than the right guide wing 9*b* simply to accommodate the width provided by a particular printer in which the exemplar cartridge 1 is to be installed.

In the embodiment herein described, bottom shutter 7 is pivoted from left-rear cover 31*a* on a left top actuator link arm 11*a* and from rear cover (not shown) on a right top actuator link arm 11*b*, located on opposite sides of shutter 7. Each link arm 11*a*, and 11*b* is integral with an actuator 13*a*, and 13*b*, respectively, each of which has a rectangular actuator surface 13*aa* and 13*bb*, respectively, which extends over the respective guide wings 9*a*, 9*b*.

A pivoted lower shutter link 15*a* and a side of the lower shutter 17*a*, pivoted to lower shutter link 15*a* and left top actuator link arm 11*a* complete a conventional four bar linkage to provide rotation of shutter 7 in response to rotation of actuator 13*a*. The rear end of coil spring 19*a* connects to a lower hook 11*aa* in link arm 11*a* to bias is shutter 7 closed when the cartridge is not inserted in a printer or other device. The front end of coil spring 19*a* connects to an upper hole 31*aa* under actuator 13*a*. A mirror image of these parts (see FIG. 3) exists on the opposite side, the corresponding part of which will be designated by the same number with "b" letters.

When cartridge 1 is installed in the printer, actuator surfaces 13*aa* and 13*bb* are pushed downward by the mating surfaces of the printer to the positions above wings 9*a*, 9*b* respectively, as shown in FIG. 1.

Cartridge 1 is inserted by a human operator grasping grips 3*a*, 3*b* through holes 3*aa*, 3*bb* and moving cartridge 1 in the direction of shutter 5 and toward the rear of the printer in which it is being installed. A series of upwardly extending ribs 21 spaced along the width of cartridge 1 under grips 3*a*, 3*b*, except at holes 3*aa* and 3*bb*, provide strength while holes 3*aa* and 3*bb* provide room for the fingers of a person to grasp grips 3*a*, 3*b*. On the left side is a relatively wide, upwardly extending tab 23. In a preferred combination of the embodiment of the invention described herein and an exemplary printer the top of tab 23 interacts with a physical sensing switch in the printer to detect that a cartridge 1 has been installed.

Front cover 25, on which grips 3*a*, 3*b*, ribs 21 and tab 23 are integrally formed, is above a separated toner hopper, as will be described. The top cover of cleaner chamber 27 is rearward of shutter 5.

Immediately inside wings 9*a* and 9*b* are raised, elongated locator surfaces 29*a*, 29*b* to which pressure is applied by a printer to firmly position the toning mechanisms of cartridge 1 when cartridge 1 is installed. Locator surfaces 29*a* and 29*b*, wings 9*a* and 9*b*, as well as rear cover 31 under wing 9*a*, are formed integral with cleaner housing 27. Also integral with these elements is front cover 25, having grips 3*a*, 3*b* and an outer cover 33 on the left side and generally coextensive in length with the length of front cover 25. Cover 33 has a U-shaped housing 35 at its top. Housing 35 traps spacer stud 37*a* as will be explained and an assembly hole 39*a* near the upper front of cover 33 and a spring-holding hole 39*b* near the lower front of cover 33.

A coupler 41 receives a drive element from a printer which contains an Oldham coupler to rotatably drive the developer roller 43 (not shown in FIG. 1) and toner adder roller 45 (not shown in FIG. 1). To the rear of coupler 41 is the shaft 47 of photoconductor drum 49 (drum not shown in FIG. 1).

Figure 2:
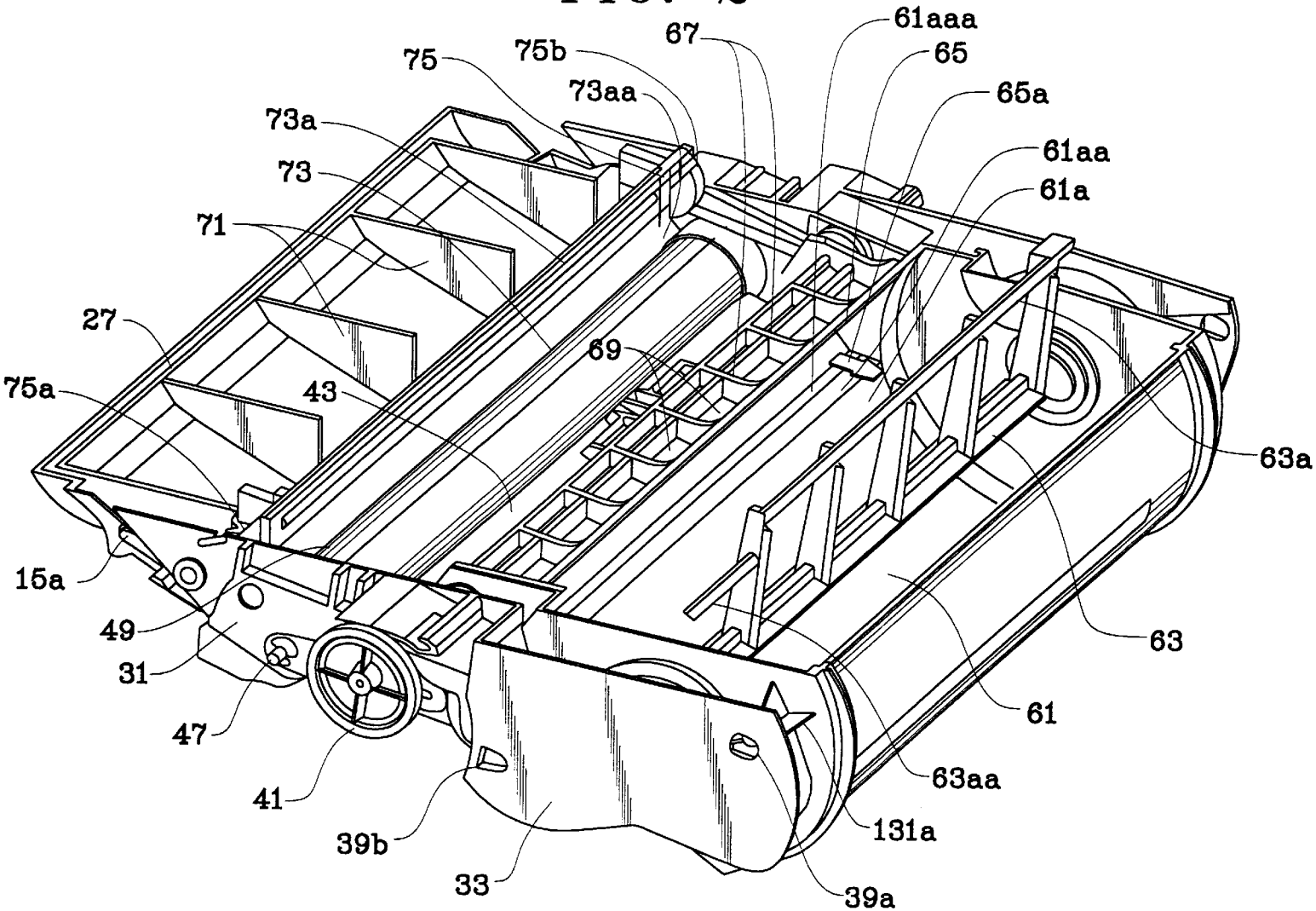
FIG. 2 is a perspective view from above and left front of the cartridge sectioned near the top.

FIG. 2 is a perspective view from above and left front of cartridge 1 sectioned near the top to show internal elements. At the immediate front is a large, cylindrical toner hopper 61, having a paddle 63, which, during operation, is rotated clockwise as seen in FIG. 2. Paddle 63 has an outer toner moving bar 63*a*, which extends across the width of hopper 61 except for a far left section 63*aa* which is inset as will be explained. The rear wall 61*a* of hopper 61 when cartridge 1 is installed for operation in a printer terminates at about one-third of the total height of hopper 61 as a flat surface 61*aa* (specifically, hopper 61 has a 106 mm diameter and the distance vertically from the lowest point of hopper 61 to the horizontal plane coinciding with the highest point surface 61*aa* of rear wall 61*a* is 35.3 mm). The upper surface 61*aa* of rear wall 61*a* is thin and flat with a slight downward angle from hopper 61 to facilitate removal of the molded part from its mold. An extension 65*a* from an agitator bar 65 has a depending tab 65*b* (see FIG. 9) which rests on upper wall 61*aa* thereby positioning agitator bar 65 slightly above upper wall 61*aa*. Extension 65*a* extends past upper wall 61*aa* to a location at which bar 63*a* of paddle 63 encounters extension 65*a* as it rotates. The surface 61*aaa* opposite surface 61*aa* from which toner exits is flat and at approximately 50 degrees from vertical ("A" in FIG. 9) when cartridge 1 is installed for operation in a printer.

Figure 9:
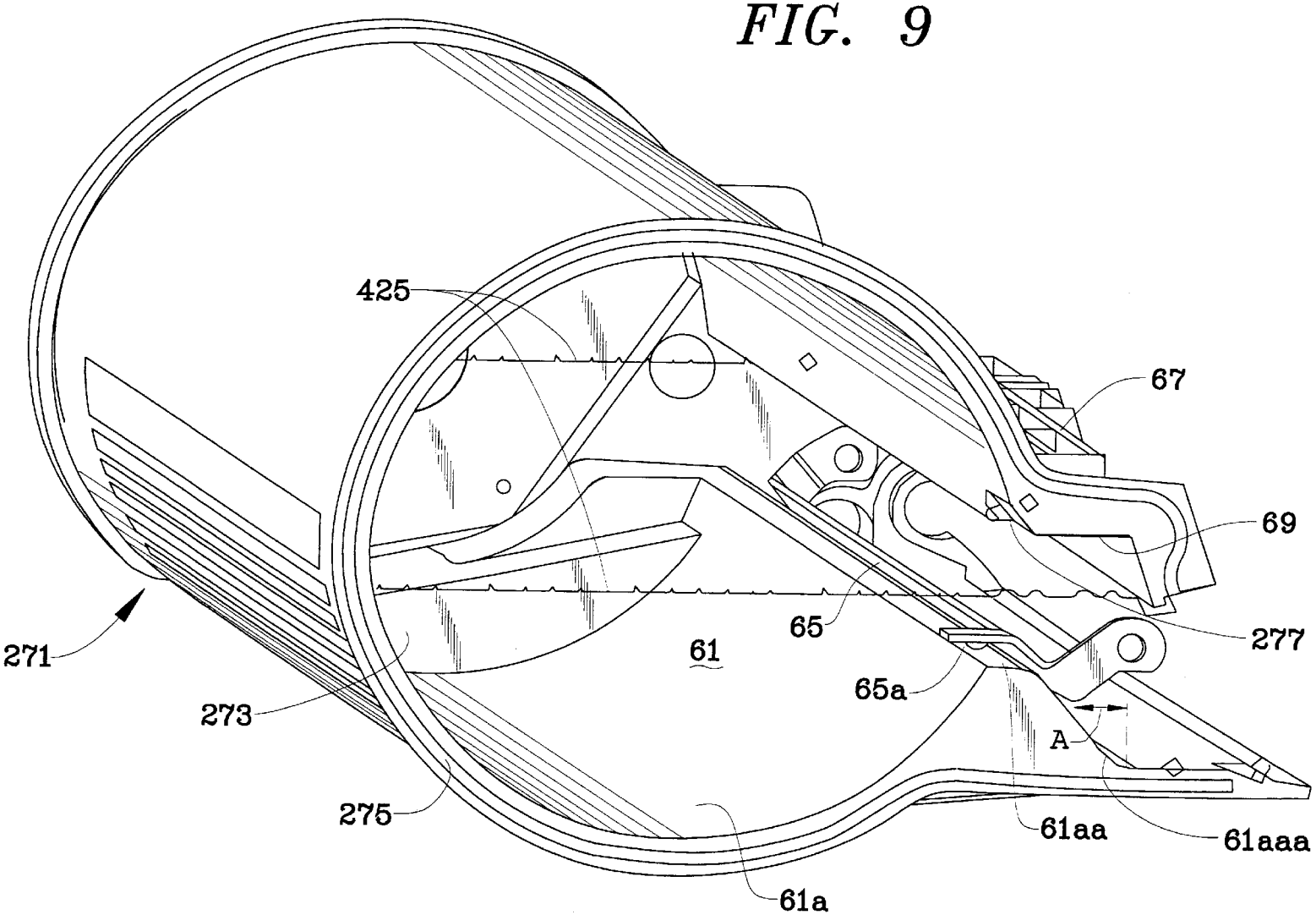
FIG. 9 is a front right perspective view of the hopper housing member.

Vertical ribs 67 located immediately rearward of rear wall 61*a* are stiffeners for top wall 69 formed about one-third down from the top of hopper 61. The toner moving bar 63*a* of paddle 63 is closely adjacent to the sides of hopper 61 except where the top of rear wall 61*a* and the start of top wall 69 form an opening for toner to be delivered rearward from hopper 61 to the toning mechanisms of cartridge 1. This is best shown in FIG. 9.

Figure 3:
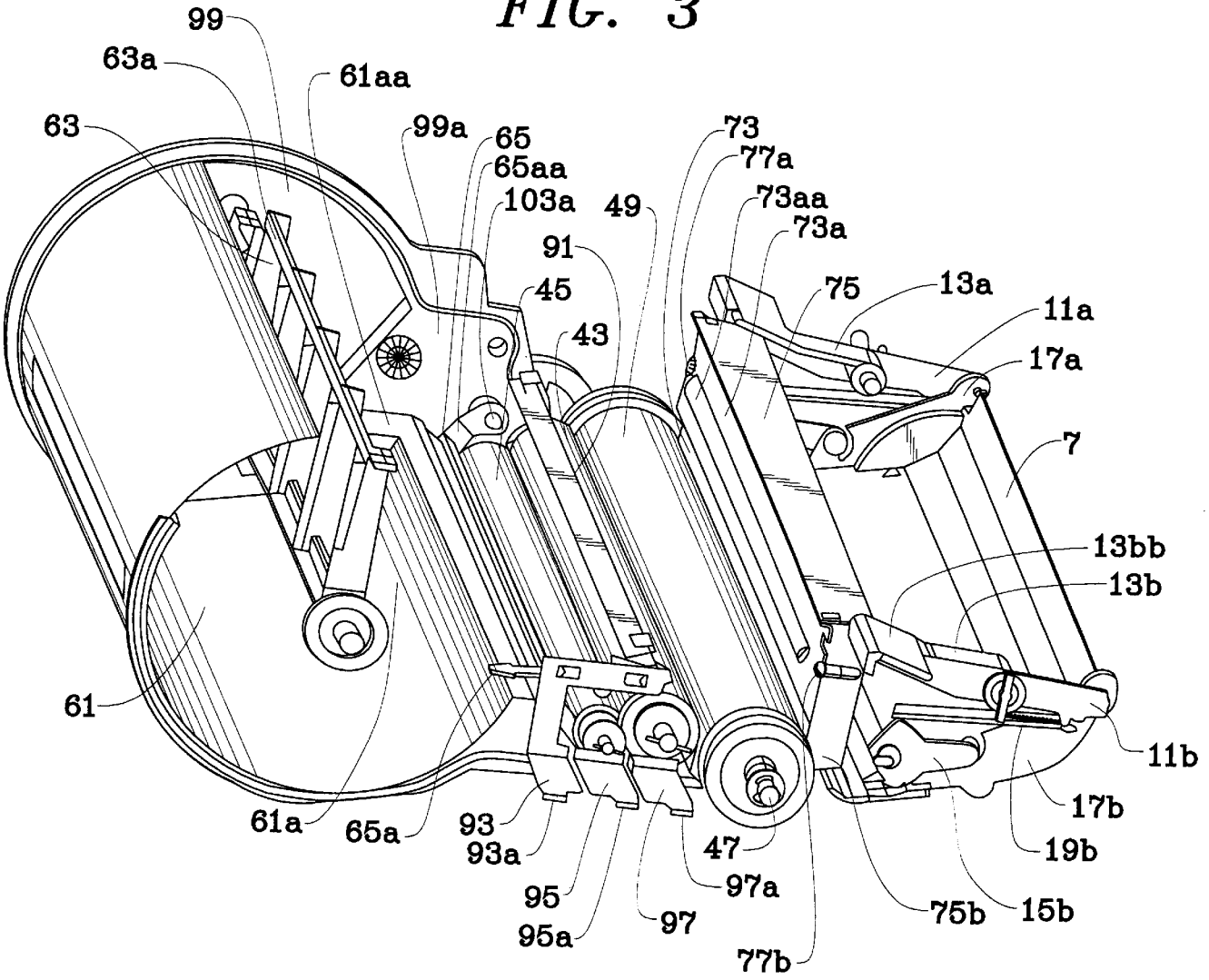
FIG. 3 is a top right front view of the cartridge with further cover elements removed.

In FIG. 2, a small part of developer roller 43 to which coupler 41 is directly attached, is seen past ribs 67. Developer roller 43 is parallel to and in contact with photoconductor drum 49. Cleaner chamber 27 has spaced, vertical internal baffles 71, which are strengthening members, as well as members which limit unbalanced accumulation of toner in chamber 27. Toner which is not transferred during development is scraped from photoconductor drum 49 by cleaning blade 73, which is mounted to a vertical panel 73*a*, having a horizontal gusset 73*aa* to increase strength. As best seen in FIG. 3, panel 73*a* is mounted to supporting member 75, which has vertical columns 75*a* (FIG. 2), 75*b* on opposite sides. Panel 73*a* is mounted to the vertical columns 75*a*, 75*b* by a screw 77*a* to column 75*a* and a screw 77*b* to column 75*b*.

FIG. 3 is a top right side view with further cover elements removed and part of the cleaner removed to illustrate the internal configuration of cartridge 1. A solid, steel-bar doctor blade 91 extends parallel with and in pressure contact with developer roller 43. Blade 91 contacts roller 43 at about 20 degrees from the vertical toward toner adder roller 45. Also shown in FIG. 3 are metal electrical contact 93 to doctor blade 91, metal electrical contact 95 to toner adder roller 45 and metal electrical contact 97 to developer roller 43. The outer ends 93*a*, 95*a*, 97*a* of the contacts bear against metal contacts in the printer when cartridge 1 is installed and thereby make electrical contact to receive electrical potentials from the printer.

The developing system of cartridge 1 is essentially very similar to that of the OPTRA family of printers sold by the assignee of this invention. As in that family of printers, toner adder roller 45 is a conductive sponge material attached to a steel shaft and developer roller 43 is semiconductive material attached to a steel shaft. When cartridge 1 is installed for operation in a printer, cartridge 1 is oriented generally as shown in FIG. 3 and the horizontal plane containing the lowest surface of toner adder roller 45 is 22.6 mm above the lowest point of hopper 61.

Toner adder roller 45 and developer roller 43 are journaled in the rearward extensions 99*a* and 11*a* (FIG. 4) of the end members 99 and 101 (FIG. 4) of hopper 61. Agitator 65 has a bent portion 65*aa* to become parallel to extension 99*a* where it is pivoted to extension 99*a* on pin 103*a*. As paddle 63 rotates, bar 63*a* contacts extension 65*a*, thereby rotating agitator 65 around pin 103*a* upward. Agitator 65 then returns to near rear wall 61*a* under the force of gravity to dislodge toner, which otherwise tends to accumulate on exit surface 61*aaa* (see FIG. 9). Since this application is directed to improved control of movement of photoconductor drum 49, further details of toner movement will be minimized in this description.

Figure 4:
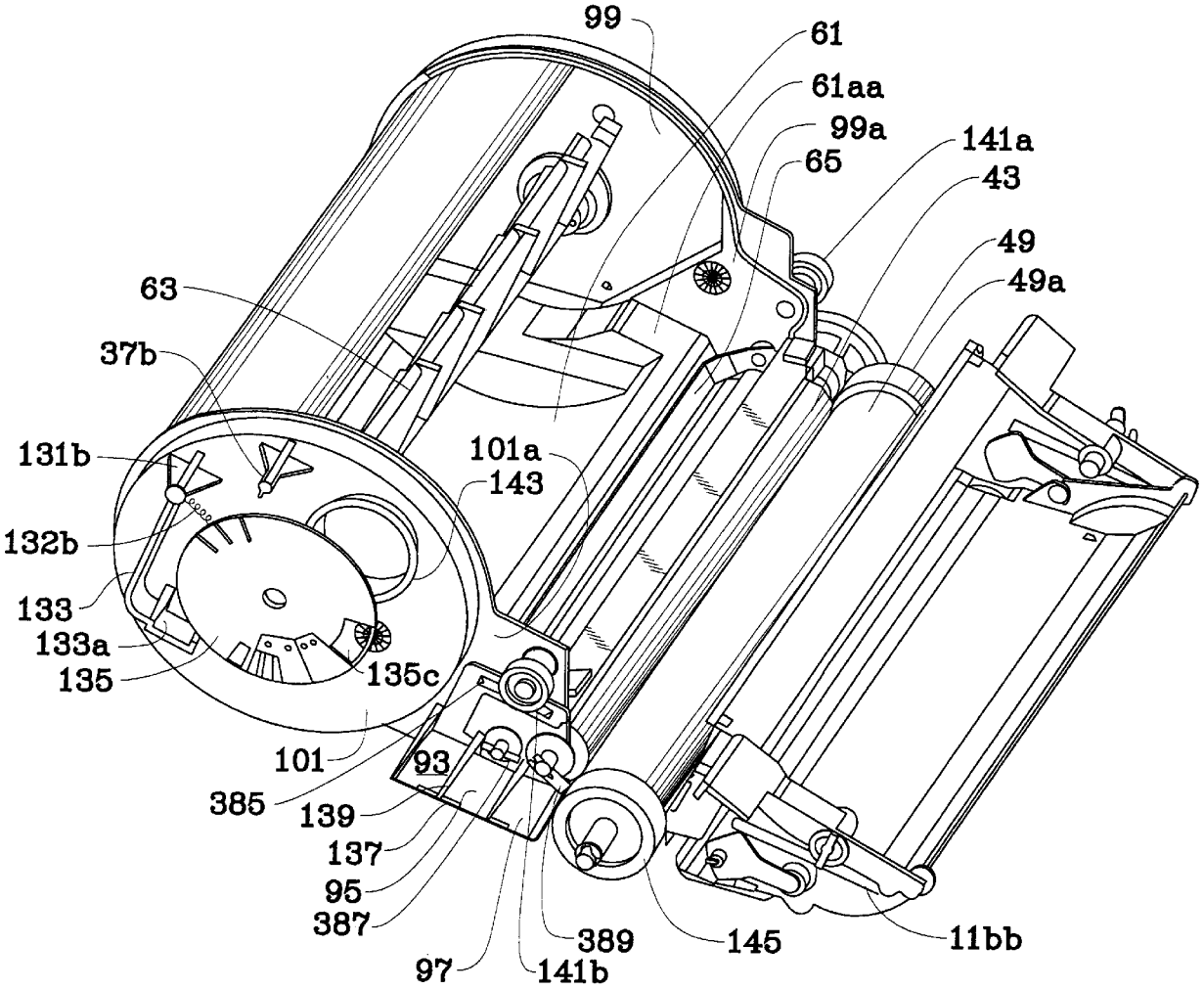
FIG. 4 is a top right rear view of the cartridge with cover elements removed.

FIG. 4 is a top right rear view with cover elements removed showing more fully the end members 99 and 101 of hopper 61 and their extensions 99*a* and 101*a*. Integral with end member 101 is spacer stud 37*b*. Under and to the front of stud 37*b* is spring mounting post 131*b*, which mounts one end of spring 132*b*, the other end of which (not shown) is mounted on hole 242 (see FIG. 8) of the cover.

Also integral with end member 101 is perpendicular shield wall 133, which extends downward and rearward to present a barrier to physically protect encoder wheel 135. Further details of the encoder wheel are not pertinent to this invention.

FIG. 4 also shows electrical contacts 93, 95 and 97 as they are supported by floor 137 which extends perpendicularly from hopper extension 101*a*. Vertical ribs 139 extend from floor 137 between contacts 93, 95 and 97 to strengthen the floor 137.

Mounting roller 141*a* is journaled to hopper extension 99*a* and symmetrical mounting roller 141*b* is mounted to hopper extension 101*a*. Rollers 141*a* and 141*b* contact inside surfaces of the cover of cartridge 1, as will be described. Surfaces 133*a* and 161*a* (FIG. 5) of hopper 61 rest on rollers (not shown) in the printer as will be further described.

Hopper end member 101 has an opening receiving a closely-fitting, resilient, cylindrical plug 143. Prior to installing plug 143, toner is loaded into hopper 61 through the open hole, then plug 143 seals the hole.

Photoconductor roller 49 has at its left end a gear 49*a* fixed to roller 49. At its right end photoconductor roller 49 has a transfer roller drive gear 145, which drives a roller in the printer when cartridge 1 is installed in the printer. Gear 49*a* is a helical gear with teeth (not shown in FIG. 4) which mesh with teeth of a gear (not shown) in the printer to receive drive torque to rotate photoconductor roller 49 during imaging operation.

Gear 145 is a molded integral plastic element having an inner side wall 600*a* and outer side wall ridge 600*b* and a central stud 602 (FIG. 10) through which shaft 47 extends. In accordance with this invention, a coil spring 604 (see FIG. 10) forms a spring clutch.

Figure 5:
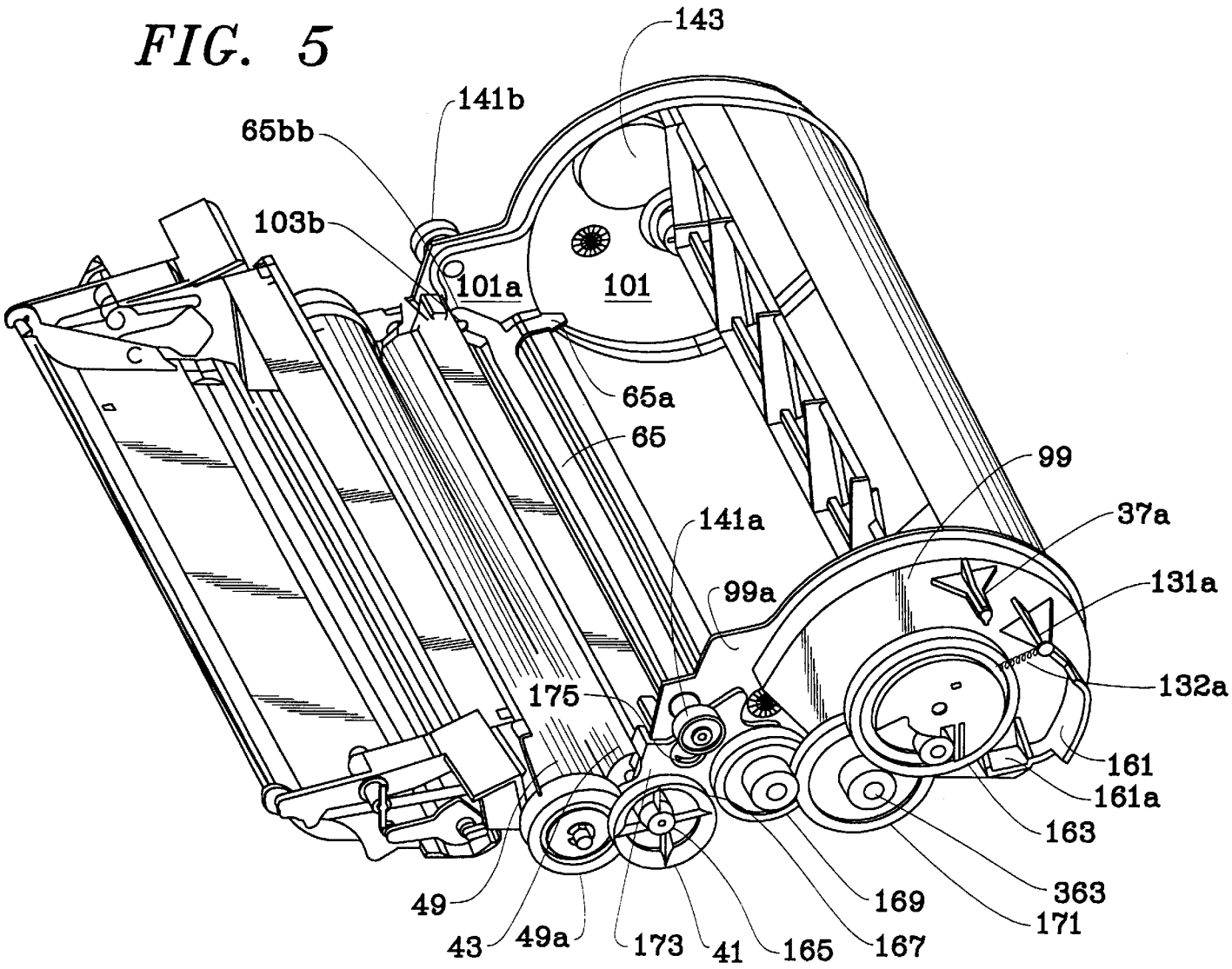
FIG. 5 is a top left rear view of the cartridge with cover elements removed.

FIG. 5 is a top left rear view with cover elements removed showing more fully the outside of members 99 and 99*a* of hopper 61. Integral with end member 99 is spacer stud 37*a*. Under and to the front of stud 37*a* is spring mounting post 131*a*, which mounts one end of spring 132*a*, the other end of which is mounted in a hole (not shown) in a member, which is an inner extension of cover 33 (FIG. 2).

Also integral with end member 99 is perpendicular shield wall 161, which extends downward and rearward to a barrier to physically protect torsional paddle gear assembly 163. The bottom portion of wall 161 forms a flat contact surface 161*a* to receive a locating roller from the printer when cartridge 1 is installed. The details of paddle gear assembly 163 are not relevant to the present invention.

Gear 49*a*, integral with the end of photoconductor drum 49, receives power from a meshing gear (not shown) in the printer when cartridge 1 is installed in the printer. Coupler 41 is integral with developer roller 43 and drives idler gear 165, which drives toner adder roller 45 (FIG. 3) by being meshed with gear 167, which is integral with toner adder roller 45. Coupler 41 receives power from a driver (not shown) in the printer which is separate from the drive (not shown) to drum 49, although preferably from a single motor in the printer.

Gear 167 drives the large gear of compound gear 169. Gear 169 drives the large gear of compound gear 171, and gear 171 drives paddle gear assembly 163. A gear plate 173, mounting gears 165 and 169, is mounted on hopper extension 99*a* by mounting screw 175.

FIG. 5 shows the end of agitator 65 opposite that shown in FIG. 3. That end has a bent portion 65*bb* to become parallel to extension 101*a* of end member 101 when it is pivoted to extension 101*a* on a pin 103*b*.

Figure 6:
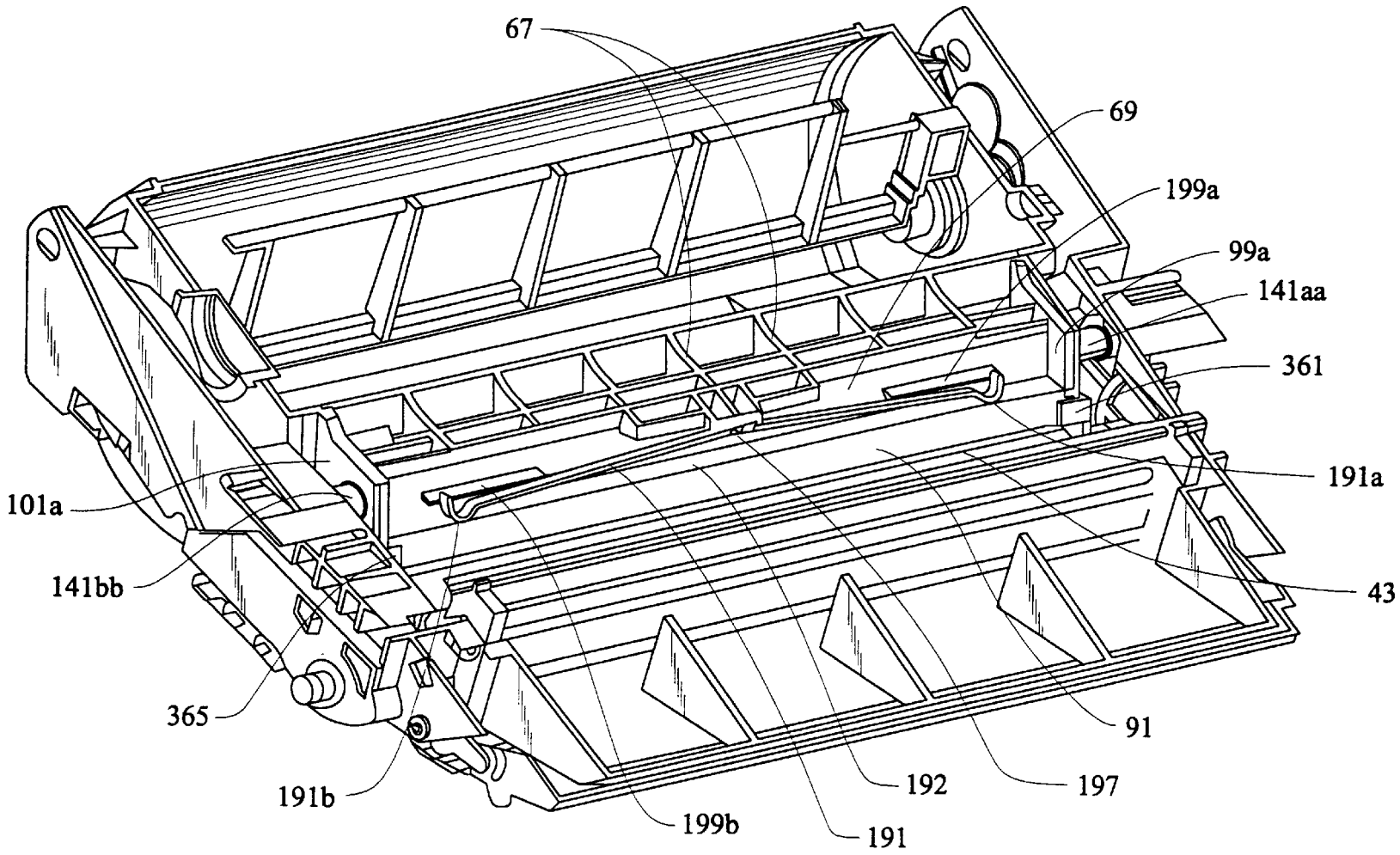
FIG. 6 is a top right rear view of the cartridge sectioned similarly to the sectioning of FIG. 2.

Continuing the detailed description of the cartridge incorporating a preferred embodiment of the present invention, FIG. 6 is a top right rear view sectioned near the top similar to the sectioning of FIG. 2. FIG. 6 illustrates more clearly the mounting of doctor blade 91 mounted to press on developer roller 43 under the bias of leaf spring 191. Blade 91 is located on the left rear by tab 361 and on the rear by extension of hopper end member 99 which forms front and back barriers for holding the left side of doctor blade 91. Similarly, on the right side, two surfaces extending from extension 101*a,* including a rear extension 365 and a front extension 366 (not shown) form front and back holding the right side of doctor blade 91, symmetric to the cage holding the left side of doctor blade 91. The top of blade 91 is held by spring 191. An adhesive tape 192 across the top of the doctor blade 91 bridges over the adjoining horizontal edge of wall 69 (FIG. 2) for sealing, as is conventional.

Spring 191 has blunt ends 191*a* and 191*b,* spaced from the center, which contact blade 91 to bias it downward on to developer roller 43. A central ledge 197, integral with ribs 67, forms a cavity receiving the center of spring 191. Horizontal ledges 199*a* and 199*b,* opposite central parts of spring 191, formed integral with ribs 67, are horizontal barriers to prevent spring 191 from moving toward the front. Preferably, so as to permit rough handling of cartridge 1 which might occur during shipment, solid upper stop members (not shown) are attached by double sided adhesive on each side between ledges 199*a* and 199*b* and the sides 99*a* and 101*a,* respectively. These are spaced 0.18 mm above the top of blade 91 and, therefore, contact blade 91 only during rough handling.

FIG. 6 also illustrates posts 141*aa* and 141*bb,* which are molded as extensions of members 99*a* and 131*a,* respectively, and supporting mounting rollers 141*a* and 141*b,* respectively (FIG. 5).

Figure 7:
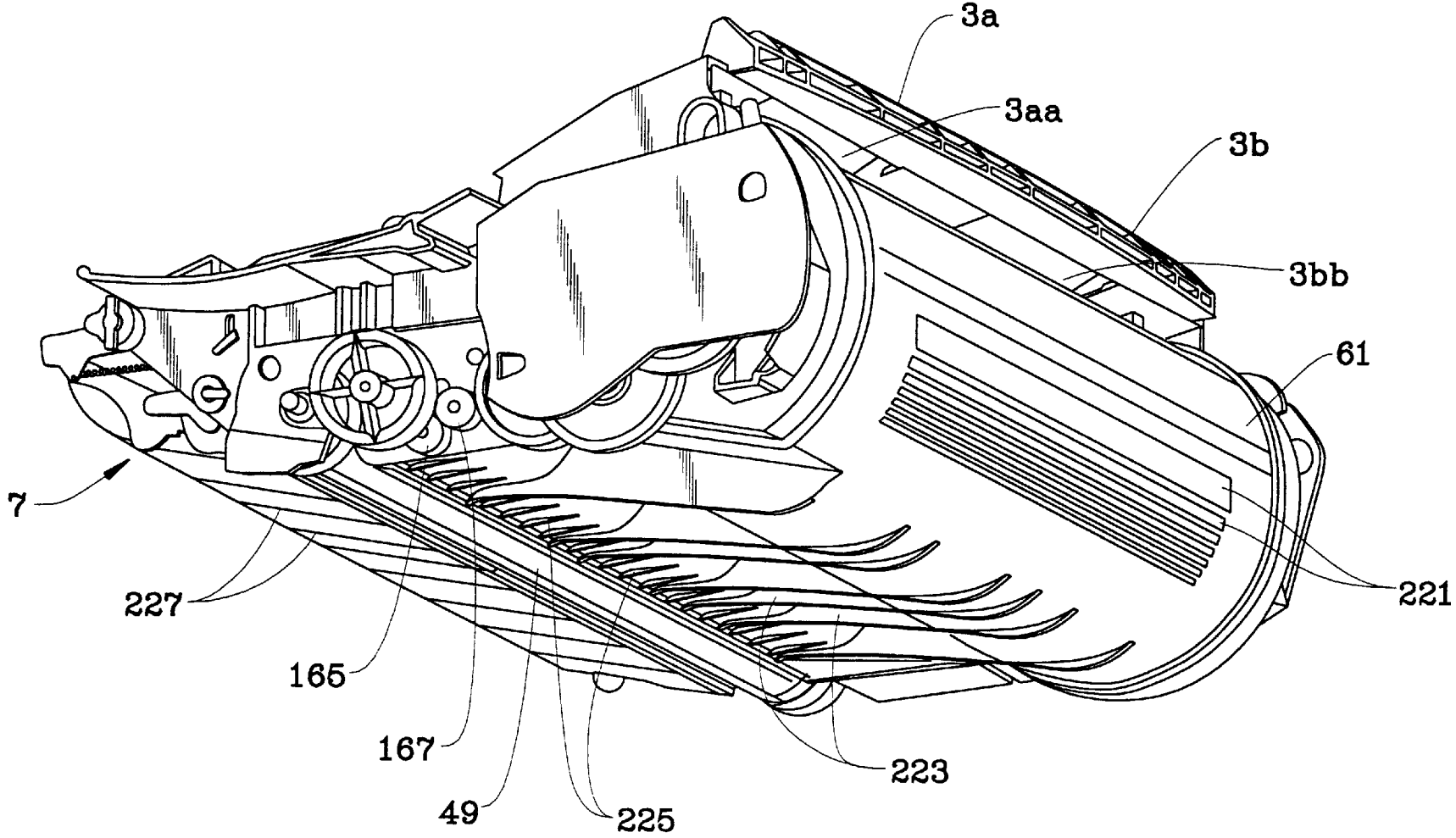
FIG. 7 is a bottom left front view of the cartridge.

FIG. 7 is a bottom left front depiction of cartridge 1 viewed externally. A series of horizontal depressions 221 along the back of hopper 61 provide a roughened surface for thumbs when fingers grasp the cartridge through opening 3*aa* and 3*bb*. A series of relatively long vertical ribs 223 integral with the bottom of hopper 61 serve as paper and other media guides, while a series of shorter ribs 225, located rearward of the start of ribs 223 and between ribs 223, prevent media snags as media encounter photoconductor drum 49, located immediately after ribs 223 and 225. Past drum 49, media encounter further media guide ribs 227 located on the bottom of shutter 7. FIG. 7 also affords a clear view of idler gear 165 and gear 167.

Figure 8:
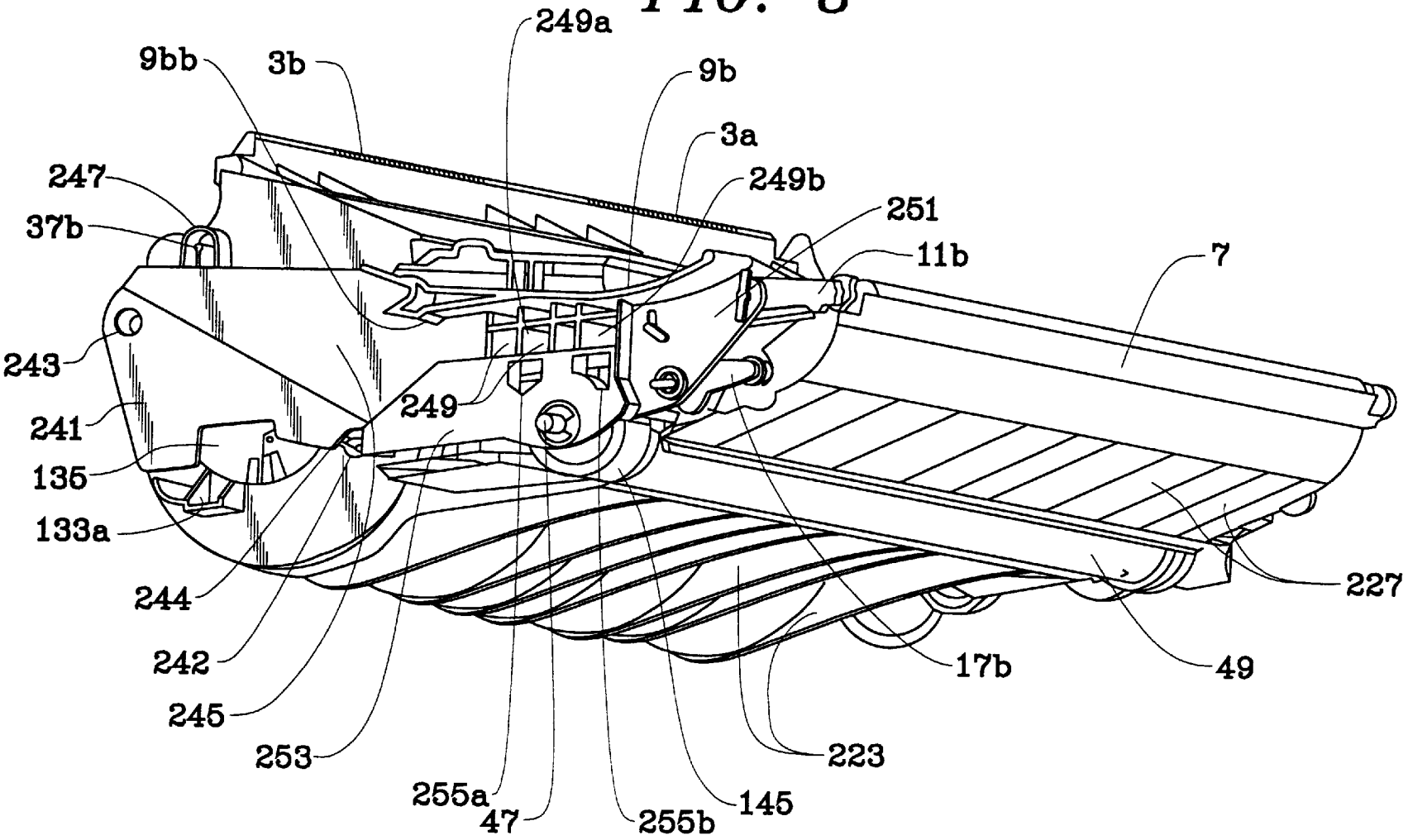
FIG. 8 is a bottom right rear view of the cartridge.

FIG. 8 is a bottom right rear depiction of cartridge 1 viewed externally. This shows the full right guide wing 9*b* with enlarged front part 9*bb*. FIG. 8 shows the right cover elements which were deleted in FIG. 6. A front lower cover section 241 is over much of the encoder wheel 135 and has an access hole 243 for ease of assembly and has an access opening 244. Cover section 241 is stepped outward a small amount to provide room for spring (not shown) to extend between post 131*b* (FIG. 4) and hole 242. Generally, above and forward of and integral with cover section 241 is cover section 245, which is over the remaining upper front of cartridge 1. Section 245 has a U-shaped housing 247 at its top which traps spacer stud 37*b*. In the rearward part of section 245 opposite the area above photoconductor drum 49, are located rectangular channels 249 with the second rectangular channel 249*a* and the last rectangular channel 249*b* being open to pass air for cooling photoconductor drum 49 during operation of cartridge 1.

The far rear portion 251 of this particular embodiment of the invention herein described mounts links 11*b* and 17*b* to shutter 7. A bottom section 253 of the cover located under and forward of passages 249*a* and 249*b* mounts the shaft 47 of photoconductor drum 49 and has two upper symmetrical vent holes 255*a* and 255*b* to pass air for cooling drum 49.

FIG. 9 is a front right perspective view of the molded plastic member housing 271 which forms the central portion and central extension of hopper 61 with end member 99 attached and agitator 65 installed. It is seen to form a cylindrical chamber with an exit opening formed between wall 69 and wall 61*a*. An inset 273 at the bottom rear of hopper 61 provides space for rollers in the printer. As best seen in FIG. 2, paddle bar 63*a* has an inset 63*aa* to clear inset 273.

Member 271 has a slot 275 around its right side. A directly similar slot is around the left side. End member 101 has a mating ridge 321 (not shown). During manufacture slot 275 is mated with that ridge in end member 101 and the two are welded together with ultrasonically created heat. Member 99 is welded to the left side of member 271 in the same manner with ridge (not shown) inserted in a mating slot (not shown) on the left side of member 271.

A notch 277 above agitator extension 65*a* allows for sufficient rotation of agitator 65 to allow paddle arm 63*a* (as best seen in FIG. 2) to pass beyond extension 65*a* while preventing a full turn-over of agitator 65.

Developer Assembly

The housing 271 and its attached end members 99 and 101, form toner hopper 61. As best seen in FIG. 5, extension 101*a* journals toner adder roller 45 and developer roller 43. Gear plate 173, which is attached to extension 99*a* by screw 175, journals the opposite ends of toner adder roller 45 and developer roller 43. Accordingly, a single unitary assembly is formed of the hopper 61 rearward to and including developer roller 43.

Photoconductor and Cover Assembly

Front cover 25 grips 3*a,* 3*b,* left outer cover 33, rear wall 31, (FIG. 1) right cover sections 241, 245, and 251, (FIG. 8) wings 9*a,* 9*b* and cleaning chamber 27 are a single molded part. Photoconductor 49 is journaled in this part with its shaft 47 extending past the covers on opposite sides. Shutter 7 is movably supported to left cover 31 and right rear cover 251. Accordingly, a single unitary assembly is formed of the cover members, the photoconductor drum 49 and the shutter 7.

In use, springs 132*a* (connected as described at the left side of cartridge 1 at an extension of cover 33) and 132*b* pull the developer roller 43 against the photoconductor drum 49 at a predetermined tension. When cartridge 1 is picked up, the developer assembly and the photoconductor and cover assembly rotate under gravity until stud 37*a* (FIG. 1) contacts housing 35 and stud 37*b* (FIG. 8) contacts housing 247, thereby holding the two assemblies together.

Toner

In a preferred embodiment cartridge 1 employs monocomponent electrophotographic toner which may be basically conventional. The amount of toner in hopper 61 is limited by pressure impairing print quality and sensing of toner level by toner resistance on paddle 63. When cartridge 1 is in the installed position, a typical top level of toner will be somewhat above the upper barrier wall 61*aa*. The presence of toner at a highest level is indicated in FIG. 9 by surface lines of toner 425, but the toner is shown otherwise as transparent for clarity. The actual toner is, of course, an opaque, dry powder. During use, the toner is depleted to lower levels and it is moved by paddle 63. As is conventional, developer roller 43 applies toner 425 to photoconductor drum 49 to develop electrostatic images on photoconductor drum 49.

Drag Elements

Figure 10:
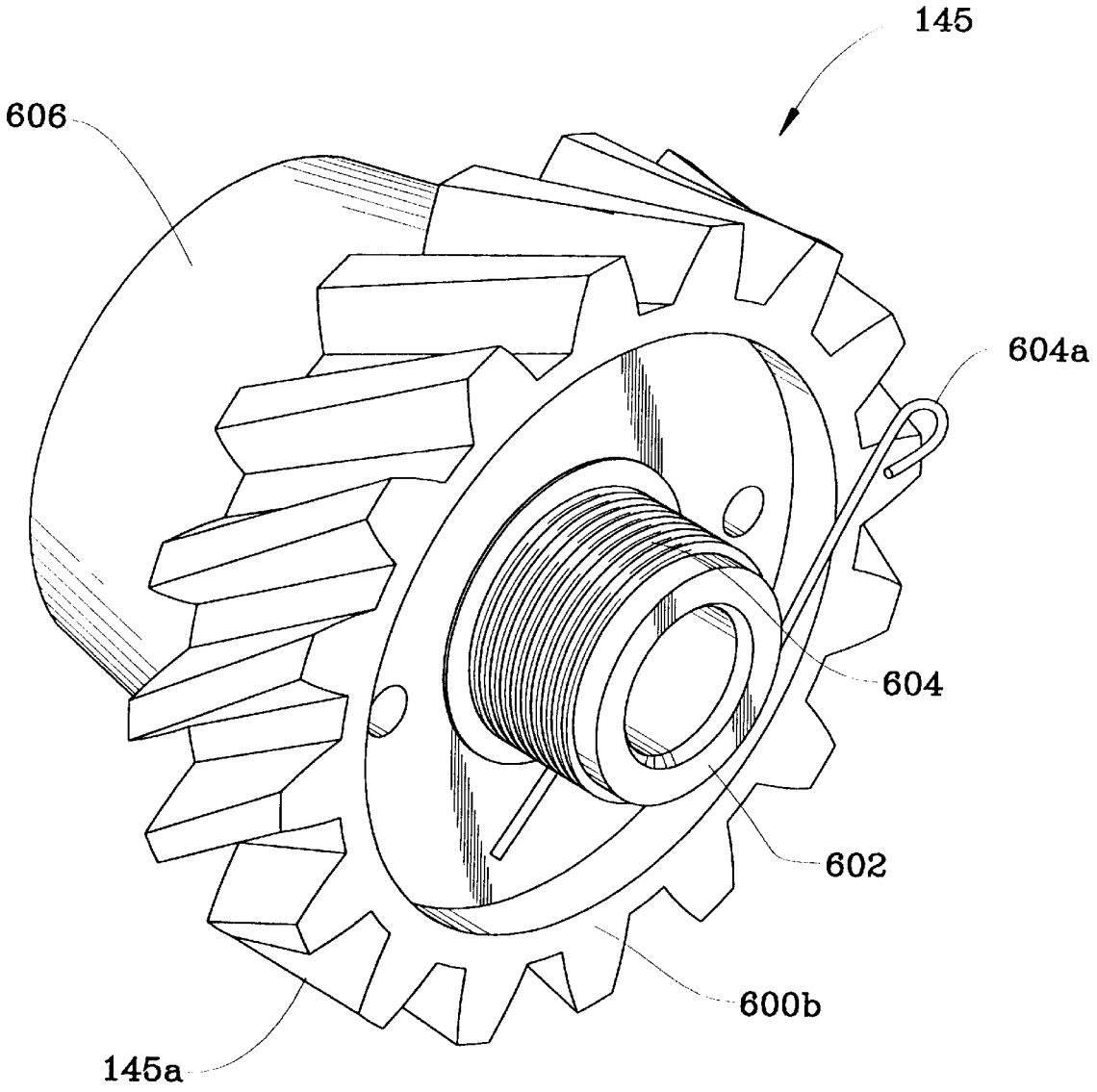
FIG. 10 is a reproduction of a photograph of a perspective view of the installed coil spring.

FIG. 10 shows details in the nature of a photograph of the gear 145 having coil spring 604 wrapped on stud 602. The tapered portion 606 opposite stud 602 enters photoconductor drum 49 to make a press fit within. Accordingly, in operation 145 is fixed to drum 49 and turns with it to form an assembly with drum 49. Outer side wall ridge 600*b* is seen in FIG. 10, and the teeth 145*a* are seen as helical gear teeth. Spring 604 has outer tang 604*a,* which is blocked from moving during normal operation so that a spring clutch is formed, (i.e., spring 604 is loosened by the blocking of tang 604*a* unwinding 604). Tang 604*a* is not blocked on the opposite side as any backward motion of gear 145 with tang 604*a* blocked would strongly tighten spring 604 on stud 602.

Figure 11:
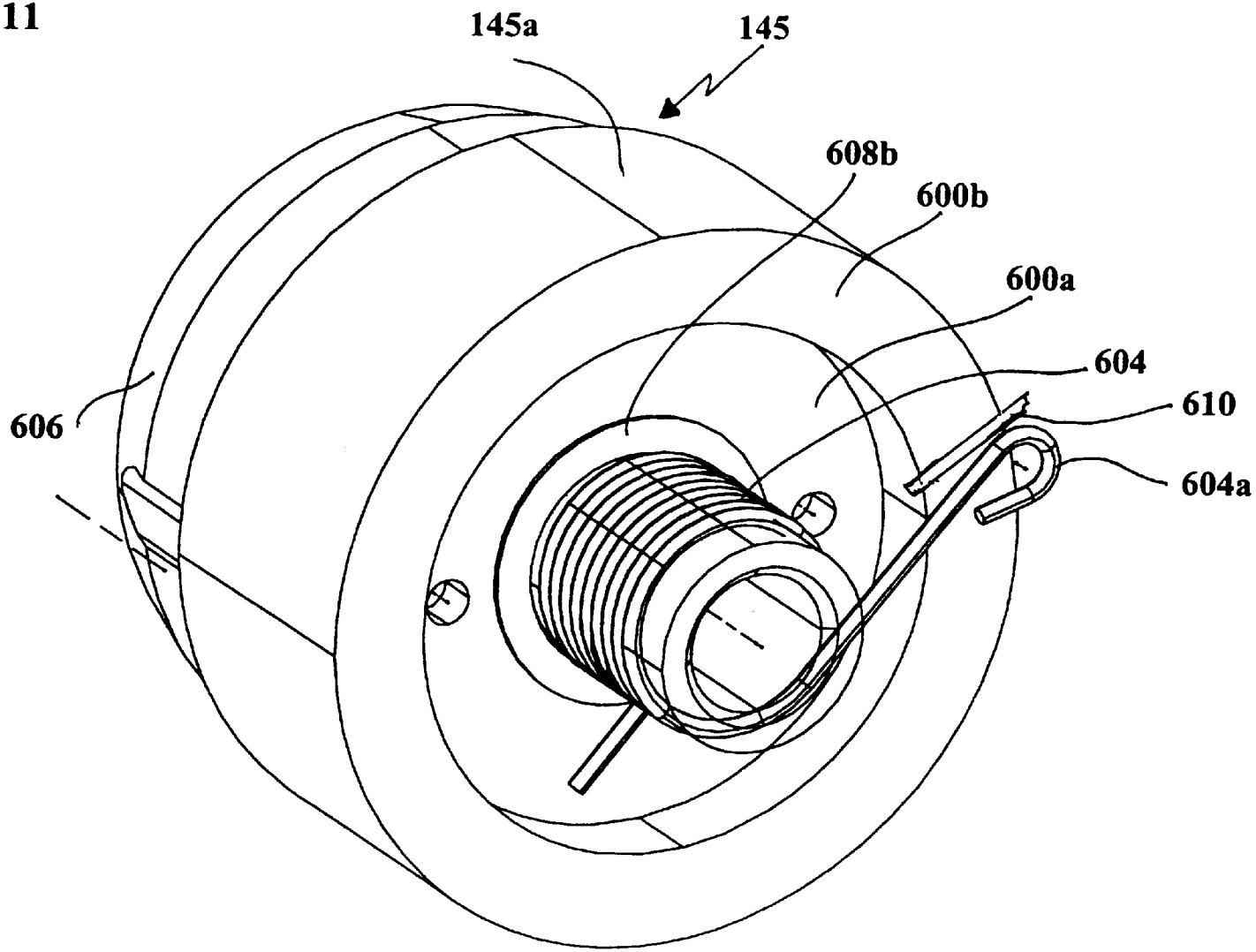
FIG. 11 is a line drawing of a perspective view similar to FIG. 10.

FIG. 11 is a larger line drawing similar to FIG. 10, but showing the teeth 145*a* only by their outside diameter. FIG. 11 shows the inner side wall 600*a* and the outer washer 608*b*. FIG. 11 also shows illustratively a ridge 610 in cover 253 which blocks tang 604*a* as shown during normal rotation of drum 49 during imaging.

Figure 12:
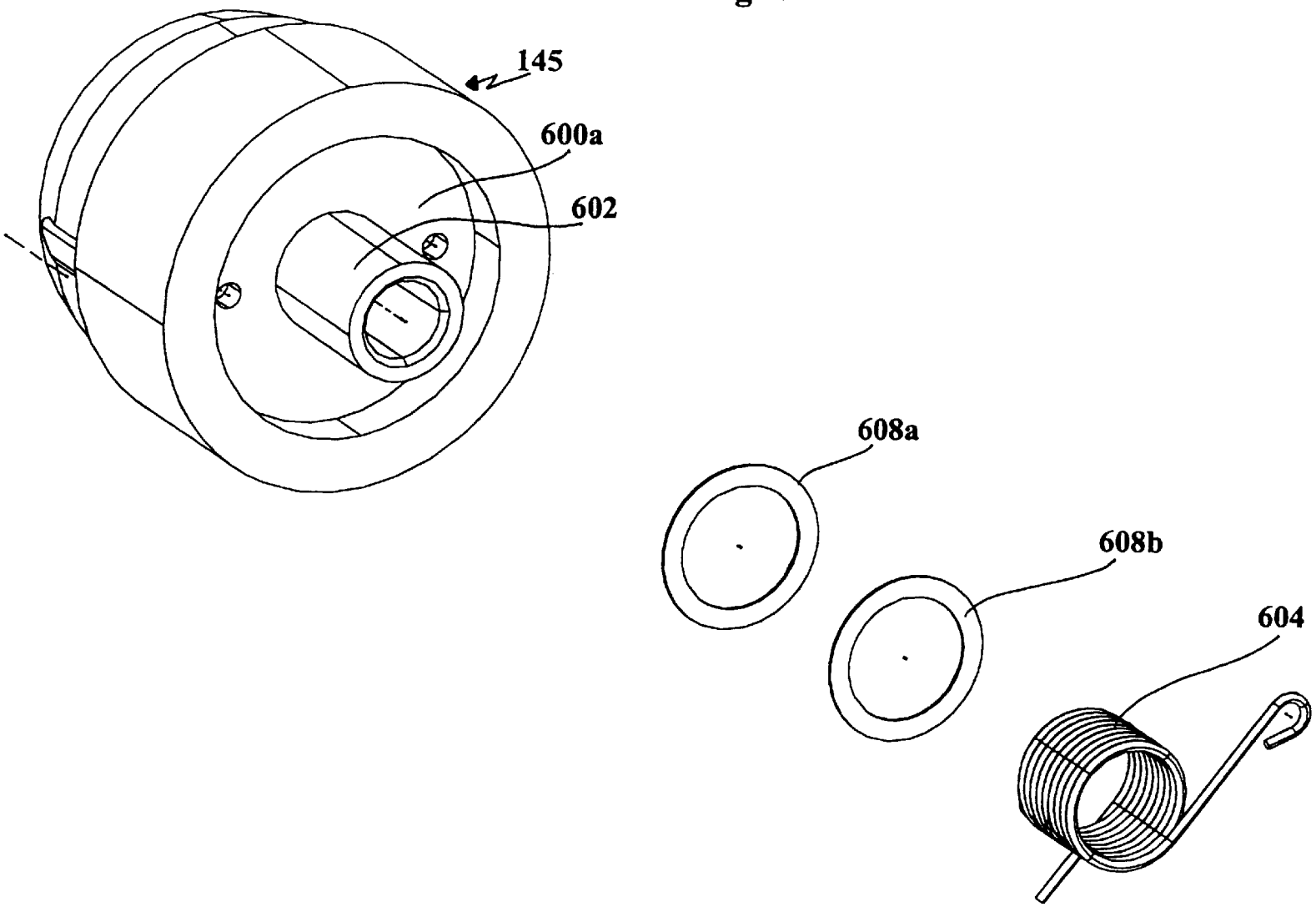
FIG. 12 is an exploded view otherwise similar to FIG. 11.

As best seen in the exploded view of FIG. 12, two washers 608*a* and 608*b* made of fluorocarbon and, therefore, of low friction are on stud 602 and separate the side of spring 604 from the side wall 600*a* of gear 145. When spring 604 moves or is mechanically biased toward side wall 600*a,* washer 608*a* contacts side wall 600*a* and washer 608*b* contacts spring 604. As the friction between washers 608*a* and 608*b* is lower than the friction between washer 608*a* and side wall 600*a,* and is lower than the friction between washer 608*b* and spring 604, washer 608*b* is stationary during rotation of drum 49 while washer 608*a* rotates. This assures that the end of spring 604 does not contact a moving surface with enough frictional force to cause a disturbance, thereby assuring smooth operation of spring 604.

Figure 13:
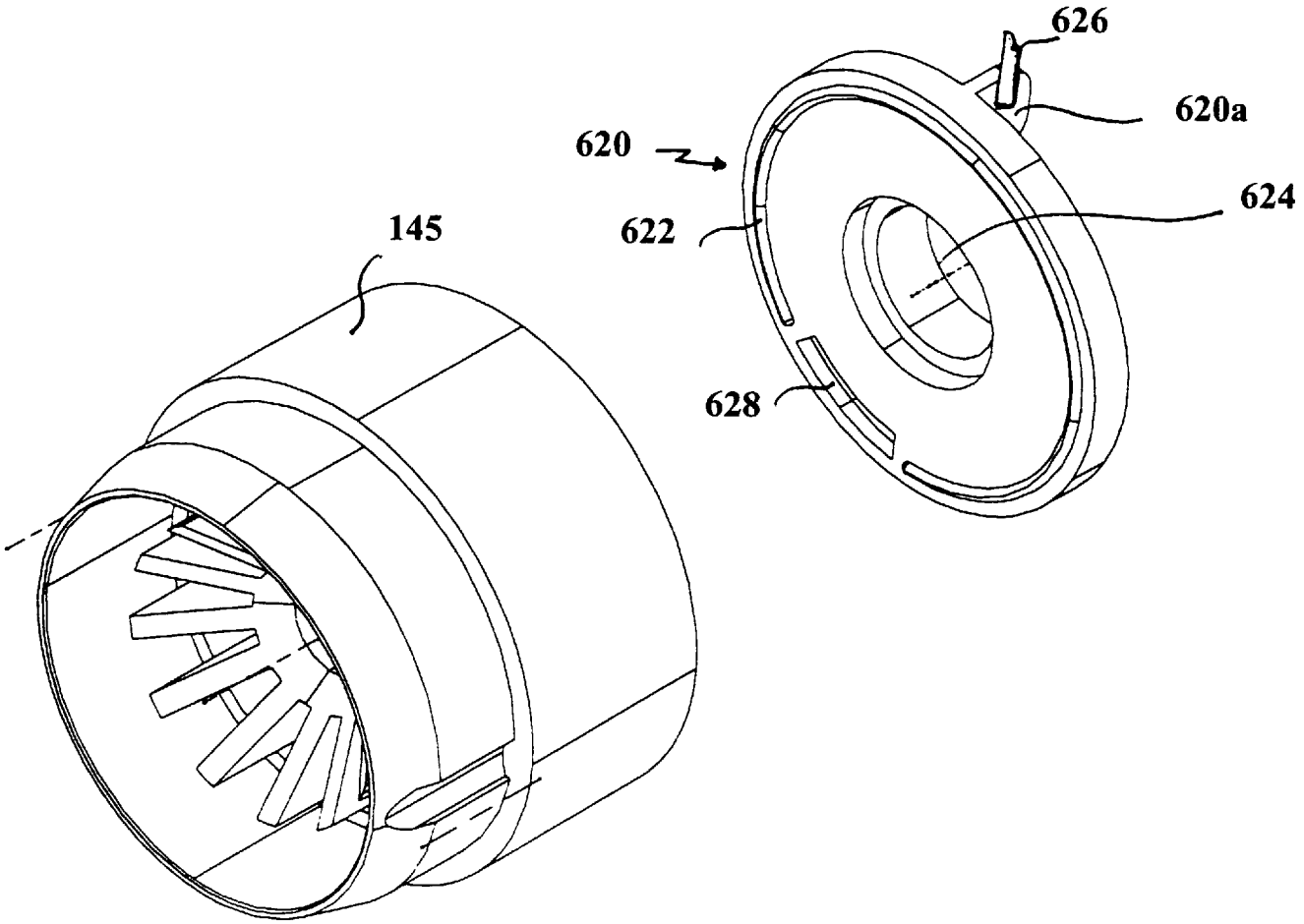
FIG. 13 is an exploded perspective view of a frictional element having a flat surface.
Figure 14:
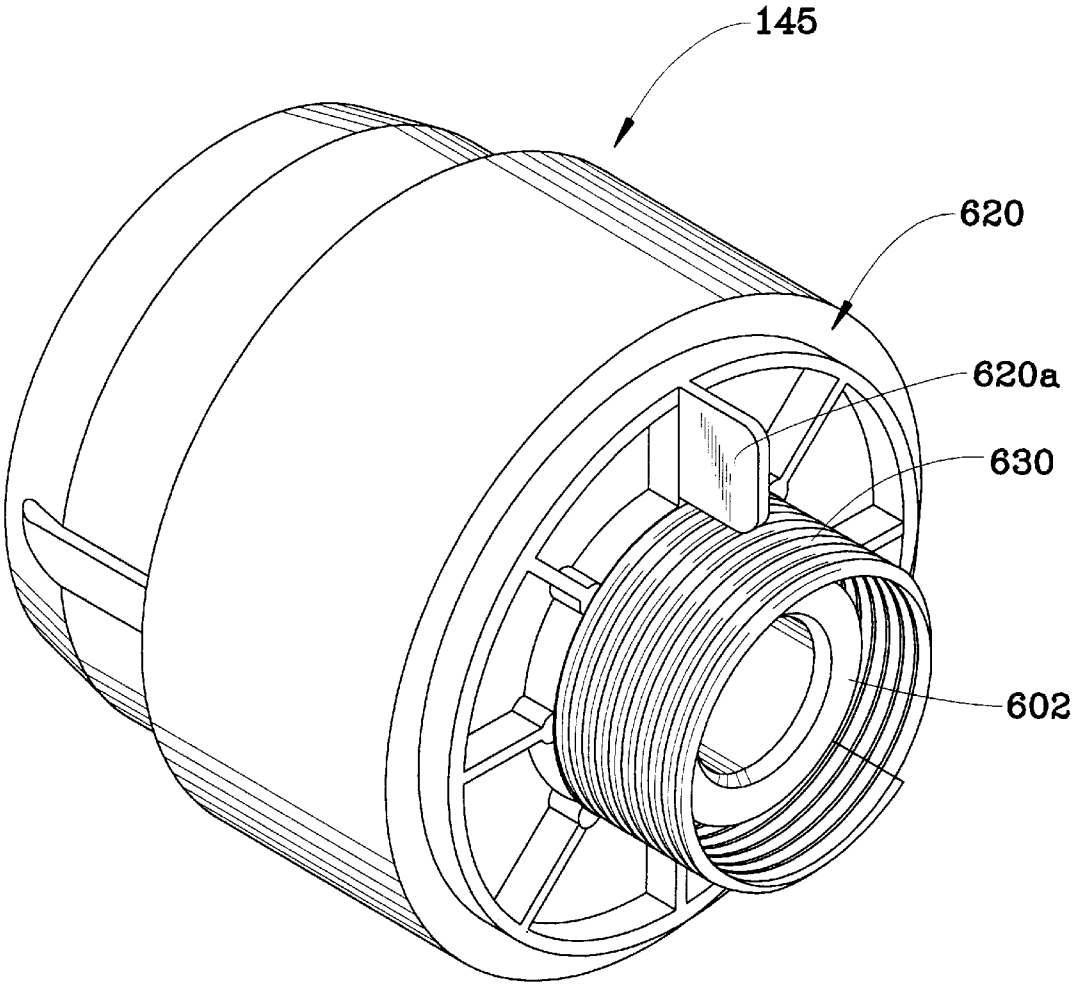
FIG. 14 illustrates the element of FIG. 13 assembled.

FIG. 13 illustrates an element 620 having a raised circular outer ridge 622 that has a flat planar surface to contact outer side wall 600*b*. Element 620 has a central hole 624 which fits over stud 602 of gear 145. Element 620 has an extending knob 620*a* which is blocked by a frame element, illustratively indicated by a ridge 626 in the cover 253. Hole 628 is to insert grease between ridge 622 and gear 145. A coil spring 630 (FIG. 14) also rests against cover 253 to bias ridge 622 against outer side wall 600*b*. FIG. 14 shows the parts assembled. Ridge 622 is pressed against outer side wall 600*b* (FIG. 11) of gear 145.

Both the coil spring 604 and ridge 622 contact a light grease, recommended for spring clutches, located where they contact the roller 49 assembly. For element 620, the grease is applied after assembly through hole 628. Spring 604 has grease where it surrounds stud 602. The grease smoothes overall operation. The drag from the spring clutch is very uniform and in an amount defined by the tightness of the inner diameter of spring 604 against stud 602. The drag from element 622 is uniform because of the grease.

Variations and alternative will be apparent and can be anticipated.

We claim:

1. An apparatus for electrophotographic imaging comprising a photosensitive roller assembly mounted for rotation in said apparatus, a gear integral with said assembly for receiving torque from a meshing gear to cause said rotation of said assembly during imaging, and a uniform frictional drag element in contact with said assembly at a location which receives torque from said gear integral with said assembly, said drag element applying friction forces which oppose said rotation.

2. An apparatus for electrophotographic imaging comprising a photosensitive roller assembly mounted for rotation in said apparatus on a central shaft, said assembly having a stud surrounding said central shaft, a gear integral with said assembly for receiving torque from a meshing gear to cause said rotation of said assembly during imaging, said rotation transmitting torque to said stud, and a coil spring clutch wound around said stud, the direction of winding of said spring being that which unwinds said spring during said rotation.

3. The apparatus as in claim 2 also comprising a first and a second washer between said spring and said assembly said first washer contacting said spring and said second washer, said second washer contacting said assembly, said washers having coefficients of friction less than the surfaces they contact so that the washer contacting the spring clutch does not move while the washer contacting said assembly does move with said assembly.

4. The apparatus as in claim 3 also comprising a grease located between said spring clutch and said stud.

5. The apparatus as in claim 2 also comprising a grease located between said spring clutch and said stud.

6. An apparatus for electrophotographic imaging comprising a photosensitive roller assembly mounted for rotation in said apparatus, a gear integral with said assembly for receiving torque from a meshing gear to cause said rotation of said assembly during imaging, a frictional surface located to press against said assembly at a location which receives torque from said gear integral with said assembly to uniformly resist said rotation, and a grease located between said frictional surface and said assembly.

7. The apparatus as in claim 6 in which said assembly has an integral side wall and said frictional surface is a flat surface biased against said side wall.

* * * * *